United States Patent [19]

Palmer et al.

[11] 4,424,454

[45] Jan. 3, 1984

[54] ELECTRICAL TIME SWITCH

[75] Inventors: Malcolm W. T. Palmer, Holt; Grahame A. Pickford, Chilcompton, both of England

[73] Assignee: Horstman Gear Group Ltd., Bath, England

[21] Appl. No.: 326,932

[22] Filed: Dec. 2, 1981

[30] Foreign Application Priority Data

Aug. 21, 1981 [GB] United Kingdom ..... 8125604

[51] Int. Cl.[3] ..... H01H 3/26

[52] U.S. Cl. ..... 307/140

[58] Field of Search ..... 307/35, 38, 39, 40, 307/140

[56] References Cited

U.S. PATENT DOCUMENTS

| | | | |
|---|---|---|---|
| 3,230,383 | 1/1966 | MacArthur | 307/38 |
| 4,259,618 | 3/1981 | Nilssen | 307/140 X |
| 4,293,915 | 10/1981 | Carpenter et al. | 307/39 X |

FOREIGN PATENT DOCUMENTS

| | | |
|---|---|---|
| 1041558 | 9/1966 | United Kingdom . |
| 1243934 | 8/1971 | United Kingdom . |
| 1547538 | 6/1979 | United Kingdom . |
| 2054908 | 2/1981 | United Kingdom . |
| 2066519 | 7/1981 | United Kingdom . |

*Primary Examiner*—Donald A. Griffin
*Attorney, Agent, or Firm*—Robert E. Ross

[57] ABSTRACT

An electrical timer switch for determining the times of day at which electricity is to be supplied to a load has different seasonal timing schedules and includes a selector circuit which selects the correct schedule in accordance with the season of the year. The timer switch may be mounted between the contact elements of an adapter which is arranged to be located between a supply of mains electricity and an electricity meter. Initial time and calendar information are supplied to the time switch by a separate monitor unit comprising a battery-fed set-up box.

15 Claims, 8 Drawing Figures

FIG. 4
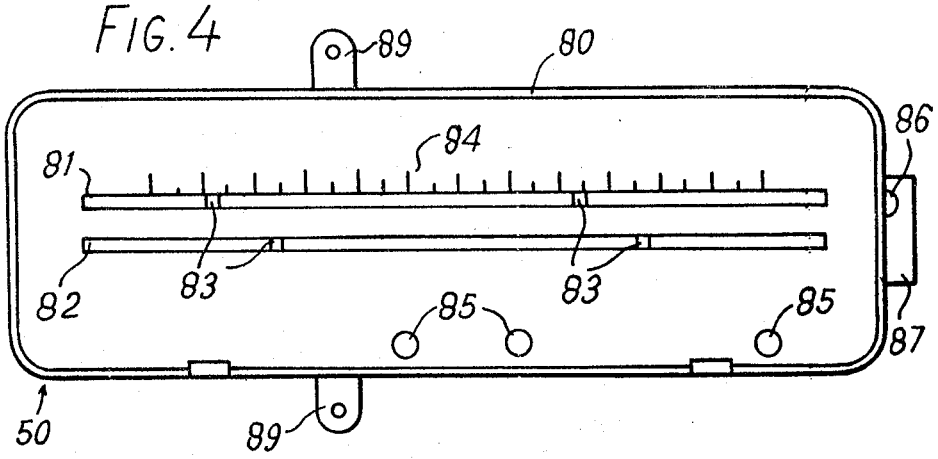
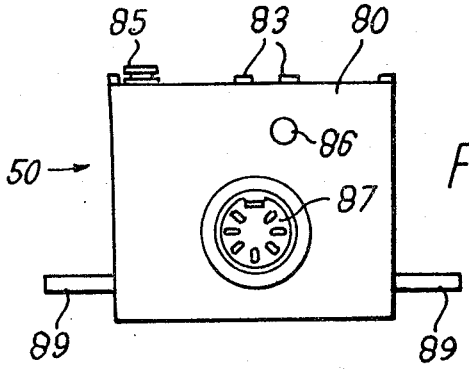
FIG. 5
FIG. 6
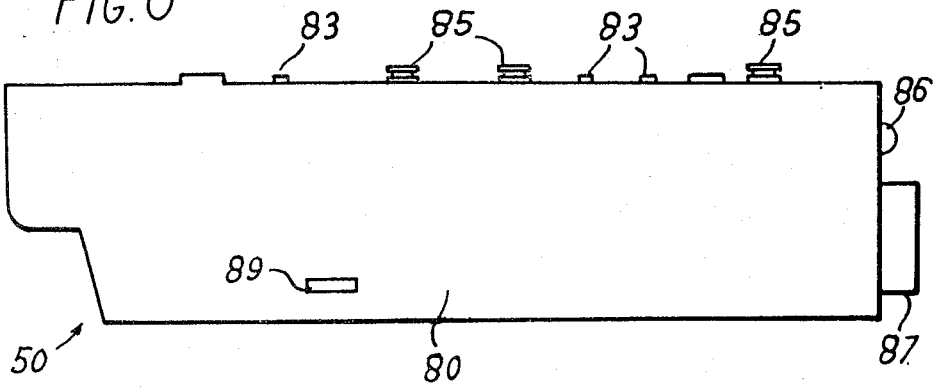

ELECTRICAL TIME SWITCH

BACKGROUND OF THE INVENTION

The present invention relates to electrical timer devices for switching the supply of electricity to an electrical load, and more particularly to such devices which have switches which are switched "on" and "off" at one or more predetermined times during the course of a day. Such timers may be used in conjunction with meter devices for the supply of off-peak electricity.

It is frequently the case that different switch-operating times are desired in winter and summer. For example, during the course of a summer's day the timing of the peak periods of electricity use differ from the timing of the peaks during winter because of the varying demands of consumers for air conditioning and heating. Thus the timing of the periods during which the electricity boards or companies wish to sell cheaper "off-peak" electricity also varies. The need for different seasonal operating times can be inconvenient, particularly when adjustment of the set times may be effected only by authorised personnel such as employees of the local electricity board or company. The fact that the switch-operating times need to be manually changed twice a year is time consuming and expensive.

Existing domestic electricity supply arrangements often incorporate a timing device, such as a clock, which is mounted on a wall adjacent to the electricity supply meter, with electrical connecting wires therebetween. The connection of the meter and timing device is a time-consuming and costly procedure. Further the timing device is often bulky. In addition there is the further disadvantage that the timing device and the connections to the meter are externally accessible which means that they can be damaged either deliberately, e.g. by vandalism, or accidentally.

Electrical timing devices and other data storing and/or data indicating devices require to be set up initially so that they operate with the correct time, date etc or other input information. The separate initial setting-up of each device, e.g. by manually-rotated knobs and/or push buttons, is time consuming and errors and inaccuracies are common.

SUMMARY OF THE INVENTION

The invention seeks to overcome or reduce one or more of the above disadvantages.

According to the invention there is provided an electrical timer device for switching the supply of electricity to an electrical load comprising first setting means determining the times of day at which electricity is to be supplied to the load in accordance with a first timing schedule, second setting means determining the times of day at which electricity is to be supplied to the load in accordance with a second timing schedule and third setting means selecting either the output of said first setting means or the output of said second setting means in dependence upon the season of the year.

BRIEF DESCRIPTION OF THE DRAWINGS

The invention will now be described in greater detail, by way of example, with reference to the drawings, of which:

FIG. 4 is a top plan view on an enlarged scale of a timer device in accordance with the present invention;

FIG. 5 is an end view of the timer device of FIG. 4;

FIG. 6 is a side view of the timer device shown in FIG. 4;

DESCRIPTION OF THE PREFERRED EMBODIMENTS

Figure 1:
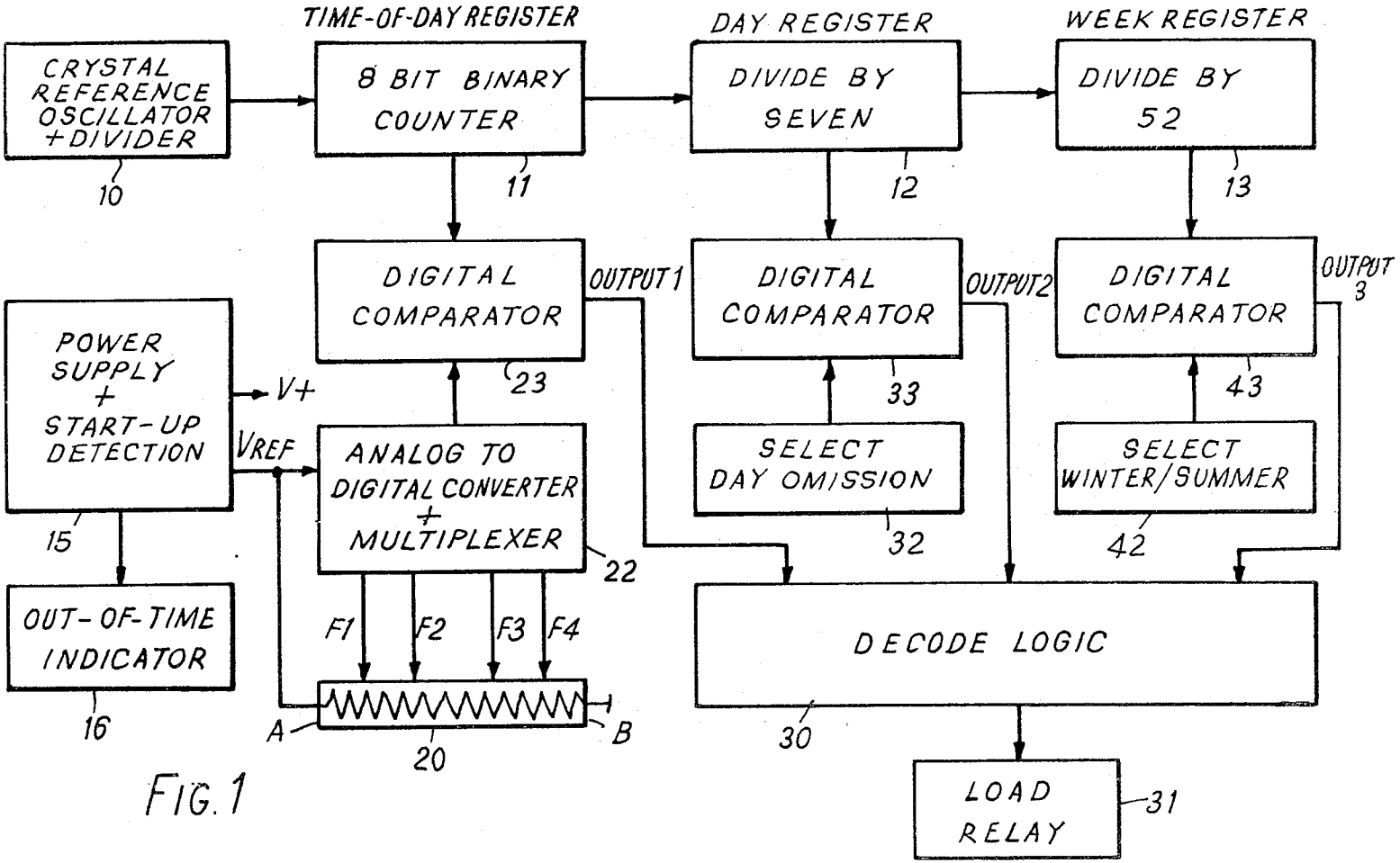
FIG. 1 depicts a switching arrangement in accordance with the present invention, in the form of a flow diagram.

Referring now to FIG. 1 there is shown a timer device that has time-of-day, day number and week number information. The device may be conveniently constituted by a microprocessor. The device keeps time using a crystal oscillator 10 as the reference source and by suitable electronic division gives time-of-day in 8 bit binary (i.e. 256 bits of resolution), seven days of the week and the fifty two weeks of the year. Alternatively the electronic division may give time-of-day and day-of-the year.

The device has a potentiometer 20 having a linear resistance element with four movable slider taps F1–F4. A reference voltage $V_{REF}$ is applied by power supply 15 across the resistance element and the taps each provide a voltage which varies in dependence upon their position along the element. The times of day represented by the voltages are as follows:

F1 is the time required to switch OFF during winter
F2 is the time required to switch ON during winter
F3 is the time required to switch OFF during summer
F4 is the time required to switch ON during summer Point A represents the time of day 25–59 and point B represents 00–01. The same reference voltage $V_{REF}$ is supplied to an analog to digital converter and multiplexer 22 which converts the position of taps F1–F4 into corresponding digital numbers with point A being 11111111 and point B being 00000000.

The output of A/D converter and time-of-day register 11 are compared by a digital comparator 23, the output of which, designated output 1, is supplied to decode logic circuitry 30 which controls the operation of a load relay 31.

Day register 12 counts the day of the week. A day omission facility is provided such that one or more days of the week, especially Saturday and/or Sunday, may be chosen such that the switching period F1/F2 (or F3/F4) can be omitted. Thus power may be offered to the consumer all weekends when these are designated as "off-peak" power periods. The required days are selected by a selector device 32. A digital comparator 33 compares the day indicated by the output of register 12 with the day or days selected by device 32 and supplies a corresponding output signal designated OUTPUT 2, to logic circuitry 30.

Week register 13 counts the weeks of the year. A device 42 is used to set the dates at which the change-over between the winter and summer schedules are to occur. Typically summer starts around April and winter starts around October, although any week can be chosen. The outputs of register 13 and device 42 are compared by a digital comparator 43 which supplies an output signal, designated OUTPUT 3, to logic circuitry 30. The seasonal changeover occurs at midnight at the end of a preselected week and in one practical arrangement is adjustable over a four week period via a hardware link as follows:

| | |
|---|---|
| Winter to summer change | 4 weeks of April |
| Summer to winter change | last weeks September<br>first 2 weeks October |

A battery standby facility is provided so that in the event of a mains supply failure the timer device continues to keep time. If the battery should run flat, or on first application of mains supply, an 'out-of-time' indicator 16 shows that the unit has lost power and will therefore not be at the correct time. Nickel-cadmium batteries are used to provide a carryover period in ambient temperatures of 30° C. to 50° C. It is most unlikely that the mains supply will be interrupted for periods longer than the carryover period.

In use, when the output of the time-of-day register 11 equals the digital number F1, the value of OUTPUT 1 switches and the logic circuitry 30 switches off relay 31, providing that:

(i) OUTPUT 2 does not indicate an omitted day; and (ii) OUTPUT 3 indicates the winter period.

When the output of register 11 equals F2, OUTPUT 1 switches and hence relay 31 is switched on.

When the output of register 11 equals F3, OUTPUT 1 switches and logic circuitry 30 switches off relay 31, providing that:

(i) OUTPUT 2 does not indicate an omitted day; and (ii) OUTPUT 3 indicates the summer period.

When the output of register 11 equals F4, OUTPUT 1 switches and relay 31 is switched on.

The time settings F1–4 for control periods, the day omission details, and the seasonal changeover data may be determined by the manufacturer or supplier of the timer device. Thus upon installation of the timer in series with an electricity meter and a load, only the following variable items of information need to be supplied:

(i) The number of the week during which installation occurs:

(ii) The day of the week on which installation occurs; and (iii) The time of day of installation.

Figure 7:
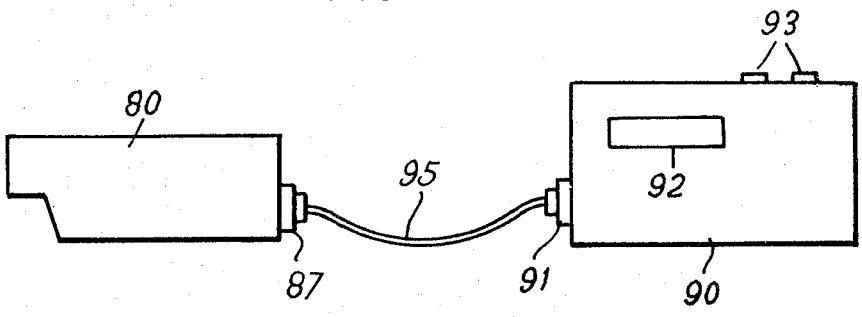
FIG. 7 is a side view of a timer device connected to a monitor unit.

The timer device may have an externally accessible socket and the above items of information may be supplied by a separate monitor unit or battery fed set up box, such as that shown in FIG. 7, having an umbilical cord which couples with the socket. The unit can then be disconnected for setting further timer devices.

The monitor unit or battery-fed set-up box may be provided with controls and/or indicators to set or show the number of the week during which installation occurs, the day of the week on which installation occurs, and the time of day of installation. The information may be set up on the controls of the unit and fed into the timer device by pressing several push-buttons in sequence, or by pressing a single pushbutton. The monitor unit may also be used to read the number of the week, day of the week and time of day already set into a timer without destroying or modifying that information. Where the electronic division of the timer device produces time-of-day and day-of-the year signals, the controls and indicators of the monitor unit are modified accordingly.

Alternatively, the monitor unit may have only a single push-button control for entering the information into the timer, with displays and/or indicators to show the information held in the unit, there being no means of setting the information into the unit manually. It may still be used to read the information already set into the timer.

Figure 8:
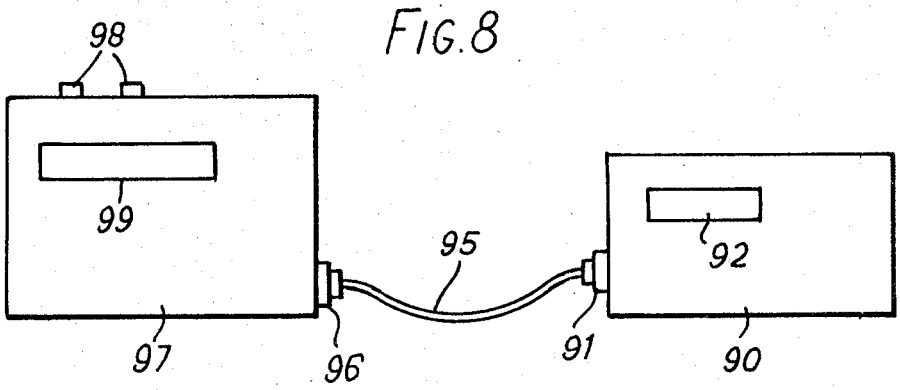
FIG. 8 is a side view of a monitor unit connected to a master unit.

The monitor unit in this case is programmed from a master unit such as that shown in FIG. 8 via an external connector, which may be the connector on the umbilical cord. The master unit has controls and/or indicators for the number of week, day-of-the-week and time of day of programming. Several monitor units may be programmed from one master unit. The master unit may also be used to programme the timer directly. Again, where the electronic division produces day-of-the year signals, the number-of-week and day-of-the-week controls and indicators are replaced by a day-of-the-year control and indicator.

An advantage of the above-described timer device is that it provides for the automatic adjustment of a timing schedule in dependence upon the season of the year. No manual or other direct adjustment is necessary. The device is easily set up during installation and requires no further attention unless the timing schedule is to be altered, or there is a prolonged power failure extending over several days.

Various modifications may be made to the above-described device. For example although the potentiometer 20 is shown as having only four taps, it can alternatively have eight taps to permit two operating periods during the course of each day. If desired, other numbers of taps may be provided instead. Thus one preferred timing schedule is:

| |
|---|
| summer 10 am–12 noon; and 3 pm–6 pm<br>winter 12 noon–2 pm; and 4 pm–8 pm |

Furthermore separate potentiometers may be provided for setting the summer and winter schedules.

Although the timer is described as having digital comparators, it may alternatively employ analog comparison means provided that suitable D/A converters are provided for the signal from the digital counters of reigsters 11, 12, 13.

In an alternative embodiment the potentiometer is replaced by one or more linear digital encoders. A/D converter 22 is omitted and the output of the encoder(s) is/are supplied directly to digital comparator 23.

As shown, the timing signals for summer and winter are multiplexed at 22; the logic circuitry 30 selects the correct signals from OUTPUT 1 by virtue of the receipt of a seasonal signal from output 3. In an alternative arrangement the output of comparator 43 is connected to circuitry 22 to select the correct signals to supply to comparator 23, i.e. F1 and F2, or F3 and F4.

Potentiometer 20 may have a resistance element which is non-linear to provide greater sensitivity in the most commonly used ranges for switching times. It may also be arranged to allows switching only during certain periods of the day. The converter circuitry 22 must be modified accordingly. The timer device may have indicators for displaying the time of day, day of the week, the omitted days, the week of the year, the season, and/or whether relay 31 is "off" or "on". It may also have means, such as a light-emitting diode, for indicating the state of the battery. This indicating means may be part of or separate from the out-of-time indicator 16.

In the above-described device, the daily timing schedule, the omitted days and the dates of seasonal changeover were set by the manufacturer. It may alternatively be arranged that one or more of these parameters may also be set (at least within a limited range) by the monitor unit via its umbilical cord.

In addition it may be arranged that the timing schedule changes more than twice a year. For example, there could be periods during spring and autumn when the timer device operates on an intermediate timing schedule.

The timer device can be used to operate lighting circuits, gas- and oil-fitted central heating systems and has numerous other domestic, industrial and commercial uses. In office heating systems, for example, the day omission feature may define days when no power is supplied to the load.

Figure 2:
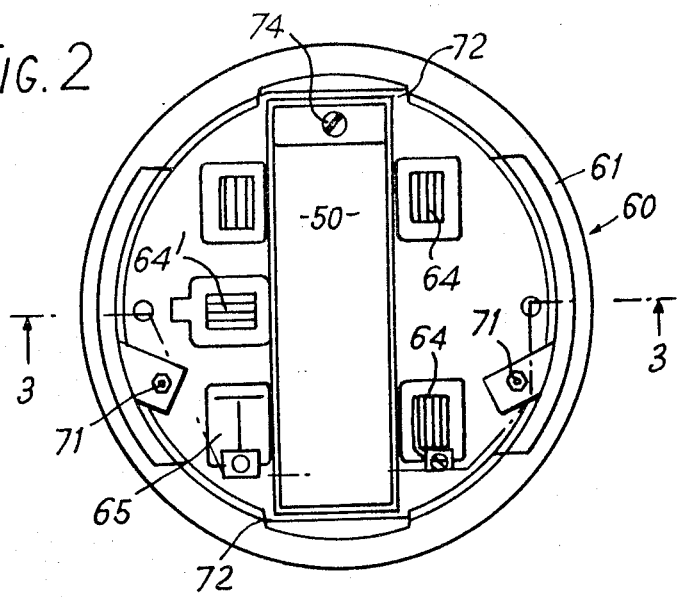
FIG. 2 shows a plan view of a timer device in accordance with the present invention mounted in an adapter for interposition between an electrical mains supply point and an electricity meter.
Figure 3:
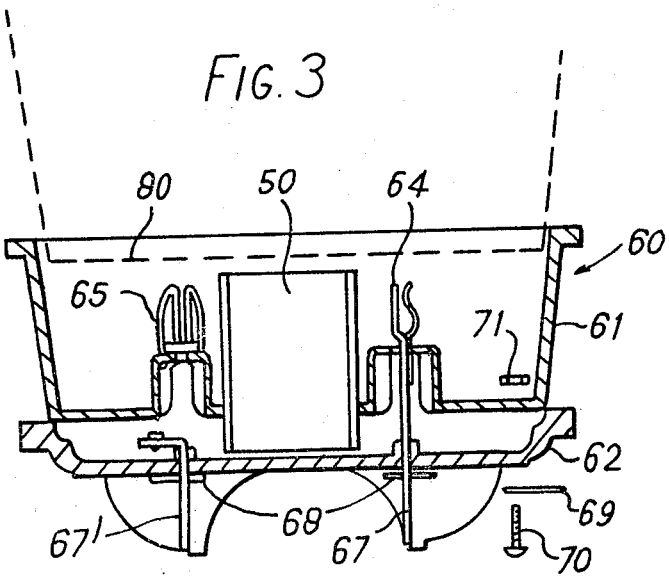
FIG. 3 is a side cross-sectional view taken on the line 3—3 of FIG. 2.

Referring now to FIGS. 2 and 3 there is shown a timer device 50 as described above mounted in an adapter 60. The adapter is arranged to be interposed between an electricity meter and a mains electricity supply point of the type found in the U.S. of America. Adapter devices of this type are disclosed in U.S. Pat. Nos. 2,606,232 and 3,599,047.

Adapter 60 comprises a shroud 61 and a base 62 both of insulating material. The inside of the shroud has five conductive sockets arranged in the same configuration as a five socket mains supply. The sockets comprise four jaw blades 64, 64' and a jaw tang 65.

Five conductive blades 67, 67' are secured to base 62 by cotter pins 68. Four blades 67 are electrically connected to a respective socket 64, 64'. The fifth blade 67' is located below jaw tang 65 but separated from it electrically. Relay contacts of the timing device are connected between jaw tang 65 and the blade 67'. In a modification, further delay contacts of the timing device are connected between the socket 64 and the blade 67 shown in FIG. 3 or between entirely separate blades located elsewhere in the adapter.

One or more earth or ground tabs 69 are each secured to shroud 61 by a mounting screw 70 and a fitting nut 71, an earth strip of the adapter being fixed under the nut. The wall of the shroud 61 has recesses 72 to receive the timer device 50 which is secured to the base 62 by one or more mounting screws 74. The timer device takes its electrical supply from the upper conductive sockets 64.

In use, blades 67, 67' are inserted into a mains supply point and the blades of an electricity meter 80 (shown in broken lines) are inserted into sockets 64, 64', 65. By virtue of the compactness of the timer device 50, it can fit within the shroud 61 without interferring with the coupling of the meter 80. The meter and adapter are then secured to the mains supply point so as to prevent unauthorised access to the timer device. The electricity supply body may apply a seal to the secured arrangement to reveal any subsequent unauthorised tampering.

In a modification for use with four pin electricity supply systems, jaw blade 64' and the corresponding blade 67 may be omitted. The adapter does not need to be connected to a meter; it can alternatively be connected directly to an electrical load such as lighting or heating means, for example by inserting jumper lead connections between upper and lower jaw blades. Furthermore, any time-operated switch may be inserted into the adapter to replace the timer device 50.

Referring now to FIGS. 4, 5 and 6 there is shown a timer device 50 in accordance with the present invention. The timer device has a casing 80 which is provided at its upper surface with two parallel slots 81, 82 along which slide the potentiometer setting elements or taps 83. The taps 83 travel along a scale 84 which corresponds to the twentyfour hours of a single day, and are used to set the on and off times of the device. The sliders in slot 81 relate to the winter timing schedule and those in slots 82 to the summer timing schedule. The device has a plurality of control buttons 85 which may be used to switch the device on, to set the day which are to be omitted, and/or to set the dates at which the seasonal changeovers occur.

A socket 87 is provided at one end of the timer device to receive the umbilical cord which is used to set up the timer device at the time of installation by feeding in current time and calendar data. An out-of-time indicator 86 is provided, corresponding to the indicator 16 of FIG. 1. Tabs 89 are provided for mounting the timer device 50, for example, in an adapter. One or more end apertures for receiving mounting screws 74 as shown in FIG. 2 may be additionally or alternatively provided.

If two control periods are required during the course of a single day then four taps are provided in each slot 81. If desired all the taps may be provided in a single slot. Furthermore the setting of the day omission facility and the dates of seasonal changeover may be effected internally, so that opening of the casing 80 is necessary to change these data.

The contemporaneous time and calendar data may be supplied from the monitor unit in the form of electrical signals where there is a direct electrical connection between the timer device and the unit. Alternatively the signals may be transmitted by electromagnetic induction; in this case the umbilical cord may be omitted.

Referring now to FIG. 7 there is shown a timer device 80 connected by an umbilical cord 95 to a monitor unit 90 which is a battery-fed set-up box. The ends of cord 95 plug into respective sockets 87, 91 of the timer device and the monitor unit. Unit 90 has a display 92 for indicating the information currently stored in the unit and control buttons 93 for bringing the stored information up to date, or otherwise correcting the stored information.

Referring now to FIG. 8 there is shown an arrangement in which the monitor unit 90 is set up or programmed by a master unit 97 instead of by control buttons 93. The master unit has a socket 96 which receives one end of the umbilical cord 95. The information stored and supplied by the master unit is controlled by buttons 98 and indicated by display 99.

It will be understood that the above description of the present invention is susceptible to various modification changes and adaptations.

We claim:

1. An electrical timer device comprising switching means for switching the supply of electricity to an electrical load, first setting means determining the times of day at which electricity is to be supplied to the load in accordance with a first timing schedule, second setting means determining the times of day at which electricity is to be supplied to the load in accordance with a second timing schedule and third setting means selecting the output of said first setting means during the winter months and the output of said second setting means during the summer months.

2. A device as defined in claim 1, and comprising timing circuitry producing time-of-day signals and week-of-the-year signals, means for comparing said time-of-day signals with the output of said first and/or second setting means, and means for comparing said week-of-the-year signals with the output of said third setting means.

3. A device as defined in claim 2 and comprising fourth setting means selectively overriding all said other setting means upon certain days of the week, said timing circuitry further producing day-of-the-week signals, and said device comprising means for comparing the day-of-the-week signals with the output of said fourth setting means.

4. A device as defined in claim 2 and comprising logic circuitry and a relay, said logic circuitry having inputs and an output, the outputs of said comparing means being connected to said inputs of said logic circuitry, and said output of said logic circuitry being connected to said relay.

5. A device as claimed in claim 1 and comprising means for supplying contemporaneous time and calendar data to the device, said calendar data comprising the number of the week within the year, whereby the device may be correctly set-up at its time of installation.

6. A device as claimed in claim 5 and comprising an out-of-time indicator for indicating that the device does not possess contemporaneous time and calendar data.

7. The combination of a timer device as defined in claim 1 and a separate unit, said timer device further comprising data input means for receiving data to be supplied to said setting means, and said separate unit comprising a source of data and a data output means, said data output means being adapted to be coupled to said data input means whereby data from said source may be supplied to said setting means.

8. The combination of claim 7, said data being contemporaneous time and/or calendar information.

9. The combination of claim 7, said data output means being adapted to be coupled to said data input means electrically or electromagnetically.

10. The combination of claim 7, said data output means including an umbilical cord, said umbilical cord being connectable to said data input means for supply of data thereto.

11. The combination of claim 7, said data being contemporaneous calendar information comprising information regarding the number of the week within the year.

12. The combination of an electrical adapter comprising first and second complementary sets of electrical contact elements and a timer device as defined in claim 1 mounted between the contact elements of the first of said complementary sets.

13. An electrical timer device comprising switching means for switching the supply of electricity to an electrical load, first setting means for determining the times of day at which electricity is to be supplied to the load during the winter months in accordance with a first timing schedule, second setting means for determining the times of day at which electricity is to be supplied to the load during the summer months in accordance with a second timing schedule, a time-of-day register, a first comparator with inputs connected to said first and second setting means and to said time-of-day register, said first comparator comparing the time-of-day as indicated by said time-of-day register with the times-of-day set by said first and second setting means, a logic circuit, the output of said first comparator being connected to a first input of said logic circuit, a day-of-the-week register, a week-of-the-year register, contemporaneous time-of-day and day-of-the week and week-of-the-year calender data input means connected to said registers, third setting means for determining the weeks of the year during the winter months in which electricity is to be supplied to the load in accordance with said first timing schedule and for determining the weeks of the year during the summer months in which electricity is to be supplied to the load in accordance with said second timing schedule, a second comparator with inputs connected to said third setting means and to said week-of-the-year register, said second comparator comparing the week-of-the-year as indicated by said week-of-the-year register with the weeks-of-the-year set by said third setting means, the output of said second comparator being connected to a second input of said logic circuit, said logic circuit being connected to said electrical load and switching the supply of electricity to said load at the times of day set by said first setting means or said second setting means in accordance with said third setting means.

14. An electrical timer device as defined in claim 13 and further comprising a fourth setting means selectively overriding all said other setting means upon certain days of the week, and a third comparator with inputs connected to said fourth setting means and to said day-of-the-week register, said third comparator comparing the day-of-the-week as indicated by said day-of-the-week register with the days-of-the-week set by said fourth setting means, the output of said third comparator being connected to a third input of said logic circuit.

15. The combination of a timer device as defined in claim 13 and a separate unit, said separate unit comprising data supply means for supplying contemporaneous time-of-day and day-of-the-week and week-of-the-year calendar data, and the separate unit having an umbilical cord for connecting said data supply means to said data input means.

* * * * *